US009243374B2

(12) United States Patent
Park

(10) Patent No.: US 9,243,374 B2
(45) Date of Patent: Jan. 26, 2016

(54) PREFABRICATED MOLD FOR CONSTRUCTION OF CONCRETE PAVEMENT

(71) Applicant: Hae-Young Park, Gyeongsangbuk-do (KR)

(72) Inventor: Hae-Young Park, Gyeongsangbuk-do (KR)

( * ) Notice: Subject to any disclaimer, the term of this patent is extended or adjusted under 35 U.S.C. 154(b) by 0 days.

(21) Appl. No.: 14/394,621

(22) PCT Filed: Oct. 22, 2013

(86) PCT No.: PCT/KR2013/009397

§ 371 (c)(1),
(2) Date: Oct. 15, 2014

(87) PCT Pub. No.: WO2014/148716

PCT Pub. Date: Sep. 25, 2014

(65) Prior Publication Data

US 2015/0069210 A1 Mar. 12, 2015

(30) Foreign Application Priority Data

Mar. 21, 2013 (KR) ..... 10-2013-0030119

(51) Int. Cl.
*E04G 11/08* (2006.01)
*E01C 19/50* (2006.01)

(52) U.S. Cl.
CPC ..... *E01C 19/508* (2013.01); *E01C 19/50* (2013.01)

(58) Field of Classification Search
CPC ..... E01C 19/60; E01C 19/502; E01C 19/504; E01C 19/508; E02D 5/02; E02D 17/04; E04G 9/05
USPC ..... 249/2, 3, 6, 15, 33; 52/71
See application file for complete search history.

(56) References Cited

U.S. PATENT DOCUMENTS 1,170,452 A * 2/1916 Lipp ..... 249/9
4,150,808 A * 4/1979 Sawyer ..... 249/111
7,290,749 B1 * 11/2007 Jessop et al. ..... 249/34

FOREIGN PATENT DOCUMENTS

JP 2001-032241 A 2/2001
JP 2005-348680 A 12/2005
KR 20-0263829 Y1 2/2002
KR 20-0433737 Y1 12/2006
KR 10-0852454 B1 8/2008
KR 10-1071691 B1 10/2011

* cited by examiner

*Primary Examiner* — Patrick Maestri
(74) *Attorney, Agent, or Firm* — Rabin & Berdo, P.C.

(57) ABSTRACT

A prefabricated mold for construction of a concrete pavement capable of being easily assembled, installed and disassembled and being repeatedly re-used is provided. The prefabricated mold includes coupling segments taperedly installed at both upper and lower ends of the mold to be butt-coupled to each other, fixing rod insertion holes formed through an upper central region of the mold and formed through the coupling segments formed at both sides of the mold, coupling grooves installed in a plural number to protrude from an inner surface of the mold having an internal space formed therein, finishing plates having a plurality of protrusions formed therein to be inserted into the coupling grooves, fixing rod insertion holes formed at the mold having a slope segment installed at a front upper portion thereof by injection-molding the mold using a synthetic resin material, and fixing rods inserted respectively into the fixing rod insertion holes to fix the mold on the ground.

2 Claims, 3 Drawing Sheets

PREFABRICATED MOLD FOR CONSTRUCTION OF CONCRETE PAVEMENT

CROSS-REFERENCE TO RELATED APPLICATION

This application claims priority to and the benefit of Korean Patent Application No. 2013-0030119, filed on Mar. 21, 2013, the disclosure of which is incorporated herein by reference in its entirety.

BACKGROUND

1. Field of the Invention

The present invention relates to a prefabricated mold for construction of a concrete pavement capable of being easily assembled, installed and disassembled and being repeatedly re-used, and more particularly, to a mold capable of butt-coupling structures of molds installed at both sides of a roadbed in which ground works are finished before deposition and aging of a slab of concrete, the molds being able to be arranged in a horizontal direction and/or a vertical direction, and capable of being constructed by injection-molding the molds using a synthetic resin material and installing the injection-molded molds in a prefabricated manner, and the molds being formed so that fixing rod insertion holes can be formed through an upper central region of the mold and formed through the coupling segments formed at both sides of the mold, and coupling grooves can be formed in a plural number to protrude from an inner surface of the mold to be coupled to protrusions formed at finishing plates.

2. Discussion of Related Art

Generally, a concrete pavement is constructed by performing a flattening process as a ground work on roadbeds, installing molds according to the width of a road, depositing and aging slabs of concrete through a finishing process, and disassembling the molds to construct the concrete pavement when these operations are completed. In this case, molds formed of woods and metals are widely used as the molds used for construction of the concrete pavement.

The molds used to construct conventional concrete pavements can be mainly divided into wooden veneer molds and metal molds according to the shapes of the molds.

The wooden veneer molds are constructed by installing molds, in which gradient posts are fixed in an inner side (a road surface) of a sheet of veneer with nails, at both sides of a road according to the width of the load, installing rebar at the rear end of the molds on the ground so as to primarily support the molds and obliquely installing supporting posts to secondarily support the molds.

As disclosed in Utility Model No.: 20-0263829 (a steel sheet mold for construction of concrete pavement) using a galvanized steel sheet, the metal molds can be supported by pressing a bent portion and inclined plane formed at an upper surface of a steel sheet body using a press, coupling connection posts and supporting posts to each other using nails, fixing the connection posts and the supporting posts in the rear of the steel sheet body, and putting rebar into the ground, and fixing the connection posts and the supporting posts in the rebar using large nails.

In addition to the steel sheet, the metal molds are formed of various kinds of metals such as galvanized steel sheet, aluminum, magnesium, and the like.

The conventional veneer molds configured thus has problems in that woods are expensive, and a great deal of work time is required since the molds are manually coupled and supported by workers, and thus a lot of manpower are also required, and also that the woods are easily broken during delivery, assembly and disassembly due to their characteristics, and thus a great deal of maintenance and repair costs are required, and the woods cannot be used continuously and repeatedly. Although the metal molds has an advantage in that they can be used semi-permanently in an economic aspect, they have problems in that they are very heavy, and thus they cannot be easily delivered, assembled and disassembled, and great deals of manpower and work time are required since the same subsequent processes as in the woods are required upon installation of the metal molds.

To solve the prior-art problems, Utility Model No.: 20-0433737 (a mold for pavement of cement concrete) in which a veneer sheet for molds, a hard fiber board, a synthetic resin, an aluminum panel, a steel sheet and the like may be selectively used as the mold is proposed.

The mold disclosed in the utility model is configured to include a body formed in a plate shape in order to divided a predetermined space, a hinge portion formed to engage both sides of the body with other bodies, a hinge shaft hole formed through the hinge portion, and a piling hole formed through a protrusion formed in the rear surface of the body to support the body on the ground.

Although the mold disclosed in the utility model has advantages in that the mold is formed of various kinds of materials, and thus it can be re-used, it has problems in that it cannot be easily delivered and installed due to its entire heavy weight derived from the structural characteristics, and that the hinge portion configured to couple one mold to another mold may be damaged or deformed when the structures of the hinge portions is repeatedly used in a state where the hinge portions are engaging crisscross, which makes it difficult to easily assemble and disassemble the molds.

SUMMARY OF THE INVENTION

Accordingly, the present invention is designed to solve the problems of the prior art, and therefore it is an object of the present invention to provide a prefabricated mold capable of being easily assembled and disassembled since both upper and lower ends of molds are butt-coupled to each other, minimizing the weight of the molds since a plurality of coupling grooves are formed from an inner surface of the mold having an internal space formed therein to be coupled to protrusions of finishing plates, being easily manufactured since the mold manufactured by injection-molding a synthetic resin configured to enhance strength of the mold since the coupling grooves formed from the inner surface of the mold serve as a reinforcing material is used, being re-used semi-permanently due to excellent strength and minimal weight, being easily delivered, assembled and disassembled, reducing a work time with minimal manpower upon assembly and disassembly of the molds which are manufactured in a prefabricated manner, and minimizing the manufacturing cost and the maintenance and repair costs as well.

According to an aspect of the present invention, there is provided a prefabricated mold for construction of a concrete pavement which is used for roads constructed by depositing and aging a slab of concrete. Here, the prefabricated mold includes coupling segments taperedly installed at both upper and lower ends of the mold to be butt-coupled to each other, fixing rod insertion holes formed through an upper central region of the mold and formed through the coupling segments formed at both sides of the mold, coupling grooves installed in a plural number to protrude from an inner surface of the mold having an internal space formed therein, finishing plates having a plurality of protrusions formed therein to be inserted into the coupling grooves, fixing rod insertion holes formed at the mold having a slope segment installed at a front upper portion thereof by injection-molding the mold using a synthetic resin material, and fixing rods inserted respectively into the fixing rod insertion holes to fix the mold on the ground.

In this case, the mold may be coupled to another mold in a horizontal direction so that the coupling segments can be butt-coupled to each other in a transverse direction so as to insert the fixing rods into the fixing rod insertion holes, respectively.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Exemplary embodiments of the present invention will be described in detail below with reference to the accompanying drawings. While the present invention is shown and described in connection with exemplary embodiments thereof, it will be apparent to those skilled in the art that various modifications can be made without departing from the scope of the invention.

Unless specifically stated otherwise, all the technical and scientific terms used in this specification have the same meanings as what are generally understood by a person skilled in the related art to which the present invention belongs. In general, the nomenclatures used in this specification and the experimental methods described below are widely known and generally used in the related art.

Figure 1:
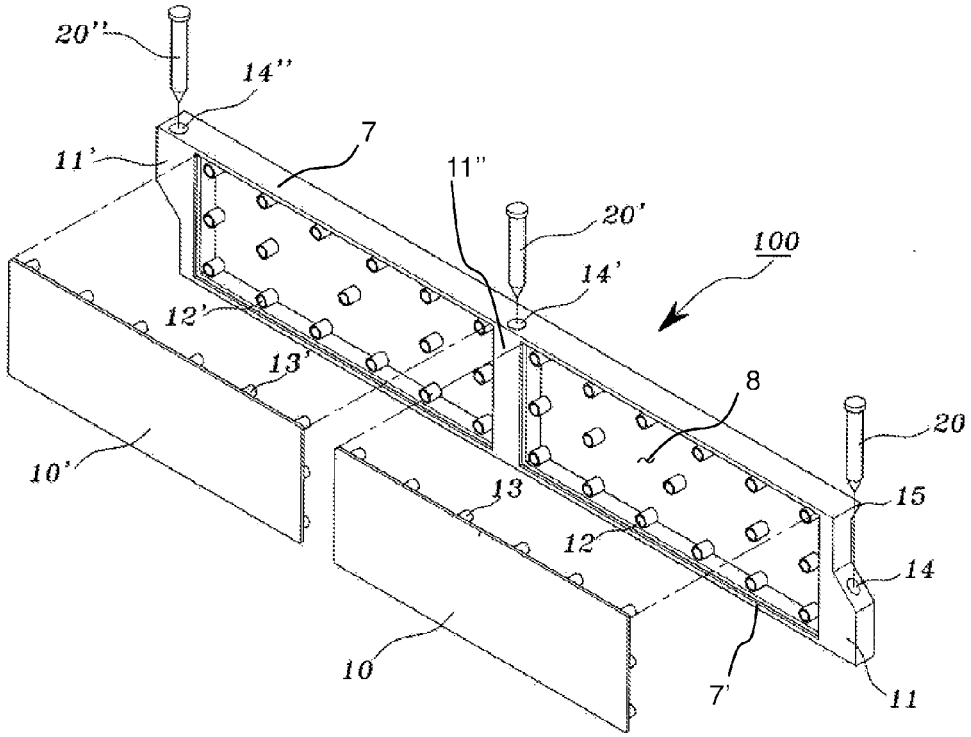
FIG. 1 is an exploded perspective view showing the entire structure of a mold according to one exemplary embodiment of the present invention.
Figure 2:
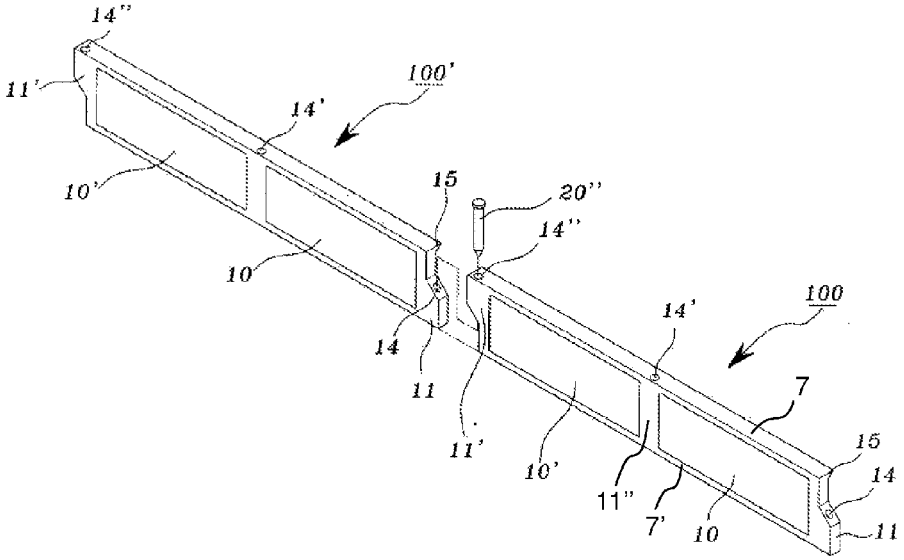
FIG. 2 is a use state diagram showing a coupling structure of a mold according to one exemplary embodiment of the present invention.
Figure 3:
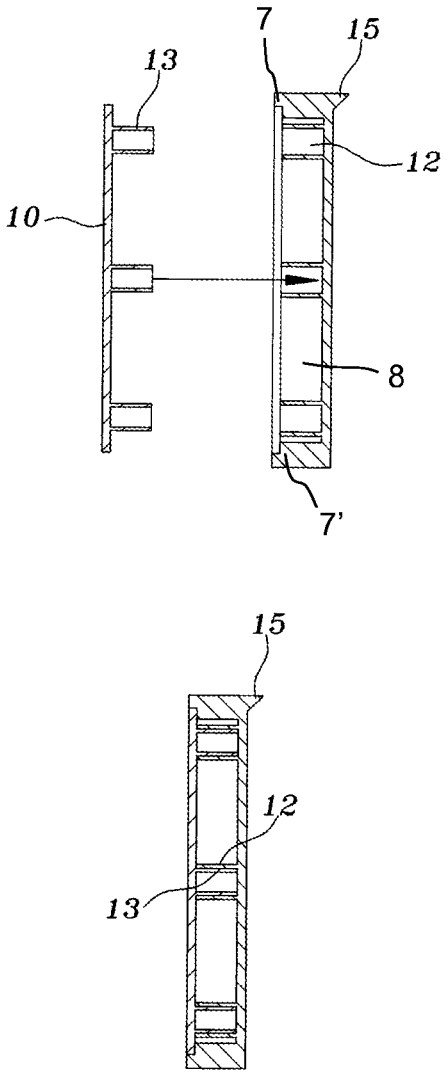
FIG. 3 is a cross-sectional view showing the mold according to one exemplary embodiment of the present invention.

FIG. 1 is an exploded perspective view showing the entire structure of a mold according to one exemplary embodiment of the present invention. Here, the mold has a structure in which coupling segments are formed at both upper and lower ends of the mold, fixing rod insertion holes are formed through the coupling segments formed at the both upper and lower ends and central region of the mold, and protrusions of finishing plates are coupled to coupling grooves formed in an inner surface of the mold. FIG. 2 is a use state diagram showing a coupling structure of a mold according to one exemplary embodiment of the present invention. Here, one mold is coupled to another mold in a transverse direction to fix the molds. FIG. 3 is a cross-sectional view showing the mold according to one exemplary embodiment of the present invention.

In the mold used for roads constructed by depositing and aging a slab of concrete, coupling segments 11 and 11' may be installed at an upper portion of a side of the mold 100 and a lower portion of an opposite side of the mold 100, respectively, which may be butt-coupled to coupling segments of adjacent mold. Also, fixing rod insertion holes 14, 14' and 14" may be formed through an upper central region of the mold 100 and formed through the coupling segments 11 and 11' formed at both sides of the mold 100, and a plurality of coupling grooves 12 and 12' may be installed in an internal space 8, which protrude from an inner surface of the mold 100. Further, finishing plates 10 and 10' may have a plurality of protrusions 13 and 13' formed therein to be inserted into the coupling grooves 12 and 12', and a slope segment 15 is installed at a front upper portion of the mold. The mold 100 can be produced by a way of injection-molding using a synthetic resin material, and fixing rods 20, 20' and 20" may be inserted respectively into the fixing rod insertion holes 14, 14' and 14" to fix the mold 100 on the ground.

In this case, the mold 100 may be coupled to another mold 100' in a horizontal direction so that the coupling segments 11 and 11' can be butt-coupled to each other in a transverse direction to insert the fixing rods 20, 20' and 20" into the fixing rod insertion holes 14, 14' and 14", respectively.

According to exemplary embodiments of the present invention configured thus, the mold 100 which can be easily manufactured, exhibit high strength, be lightweight, and be used semi-permanently since the mold injection-molded from a synthetic resin material is used when a road is constructed by depositing and aging a slab of concrete, can be easily installed, assembled and disassembled, and can be useful in reducing a work time with minimal manpower upon assembly and disassembly of the molds which are manufactured in a prefabricated manner and minimizing the manufacturing cost and the maintenance and repair costs.

As shown in FIG. 1, the mold 100 has a structure in which the coupling segments 11 and 11' are installed at both upper and lower ends of the mold 100. In this case, when one side of each of the coupling segments 11 and 11' is installed at an upper portion of the mold 100, and the other side of each of the coupling segments 11 and 11' is installed at a lower portion of the mold 100 to install the plurality of molds 100, the coupling segments 11 and 11' may be butt-coupled to each other.

Also, the mold 100 includes an upper frame 7 and a lower frame 7' in the upper end and the lower end of the mold 100, respectively, to support the mold 100. The mold 100 also includes a supporting segment 11" disposed side-by-side with the coupling segments 11 and 11' in a central region of the internal space to support the mold 100 in the central region.

Since the internal space 8 is formed in the mold 100 and a plurality of coupling grooves 12 and 12' are formed in the internal space 8, the entire weight of the mold 100 may be reduced, and the coupling grooves 12 and 12' installed to protrude from the inner surface of the mold 100 may serve as a reinforcing material.

The plurality of protrusions 13 and 13' formed at the finishing plates 10 and 10' may be inserted and coupled to the coupling grooves 12 and 12', respectively, to further reinforce the mold 100 while regularly arranging the rear ends of the molds.

As shown in FIG. 2, the coupling segments 11 and 11' installed at both sides of the molds 100 and 100' may be butt-coupled to each other, and the fixing rods 20, 20' and 20" may be fixed on the ground, respectively, using the fixing rod insertion holes 14, 14' and 14" formed through an upper central region of the mold 100 and formed through the coupling segments 11 and 11' formed at both sides of the mold 100 so as to support the molds 100 and 100' during a process of depositing and aging a slab of concrete in the molds 100 and 100'.

As shown in FIG. 3, the protrusions 13 and 13' of the finishing plates 10 and 10' may be inserted and coupled to the coupling grooves 12 and 12' in the inner space of the mold 100 to reinforce hardness of the mold 100, and the slope segment 15 may be formed at a front upper portion of the mold 100, and thus the interface between the molds 100 and 100' may be formed during a finishing process of depositing and flattening a slab of concrete, which makes it easy to perform pavement works easily.

When both lateral surfaces of the molds 100 and 100' have to be elevated to a certain height due to sections and geographies requiring the height of a concrete pavement, the molds 100 and 100' may be stacked, and the fixing rods 20, 20' and 20" may be longitudinally enlarged accordingly according to the stacked molds 100 and 100' so that the molds 100 and 100' can be fixed on the ground.

Therefore, the mold 100 according to the exemplary embodiments of the present invention can be useful in being simply manufactured since the mold 100 is manufactured by injection-molding a synthetic resin using a method of coupling the finishing plates during construction of a concrete pavement, improving the esthetic sense, being easily manufactured, exhibiting high strength, being lightweight, and being used semi-permanently. Also, the mold 100 according to the exemplary embodiments of the present invention can be useful in being easily delivered, assembled and disassembled upon construction of the concrete pavement, reducing a work time with minimal manpower since the molds are manufactured in a prefabricated manner, and minimizing the manufacturing cost and the maintenance and repair costs.

It will be apparent to those skilled in the art that various modifications can be made to the above-described exemplary embodiments of the present invention without departing from the scope of the invention. Thus, it is intended that the present invention covers all such modifications provided they come within the scope of the appended claims and their equivalents.

What is claimed is:

1. A prefabricated mold for construction of a concrete pavement, comprising:

a mold including an upper frame disposed in an upper end of the mold, a lower frame disposed in a lower end of the mold, and an internal space formed between the upper frame and the lower frame;

a first coupling segment installed at an upper portion of a first end side of the mold, the first coupling segment having a tapered face in a bottom side thereof;

a second coupling segment installed at a lower portion of a second end side of the mold, the second end side being an opposite side of the first end side, the second coupling segment having a tapered face in a top side thereof;

a supporting segment disposed side-by-side with the first and second coupling segments in a central region of the internal space of the mold;

a first fixing rod insertion hole formed through the first coupling segment;

a second fixing rod insertion hole formed through the second coupling segment;

a third fixing rod insertion hole formed through the supporting segment;

a plurality of coupling grooves formed in the internal space of the mold and protruding from an inner surface of the mold;

at least one finishing plate covering the internal space of the mold;

a plurality of protrusions protruding from a side of said at least one finishing plate, such that each of the plurality of the protrusions is coupled to a corresponding one of the plurality of coupling grooves;

a slope segment protruding from an upper edge of the mold to a lateral direction for making it easy to perform pavement works; and fixing rods inserted respectively into the first, second and third fixing rod insertion holes.

2. The prefabricated mold according to claim 1, wherein the mold is coupled to another mold in a horizontal direction such that the first coupling segment installed in the mold is butt-coupled to a second coupling segment installed in the another mold, and the fixing rods are inserted through the first fixing rod insertion hole of the first coupling segment installed in the mold and a second fixing rod insertion hole of the second coupling segment installed in the another mold, thereby being coupled each other.

* * * * *